United States Patent [19]

Aiello et al.

[11] Patent Number: 5,013,253

[45] Date of Patent: May 7, 1991

[54] FLUORESCENT LIGHT CONNECTOR ASSEMBLY

[75] Inventors: Richard E. Aiello, Tobaccoville; Christopher L. Allgood, Lewisville; Donald G. Stillie, Winston-Salem; Allan J. Sykora, Kernsersville, all of N.C.

[73] Assignee: AMP Incorporated, Harrisburg, Pa.

[21] Appl. No.: 482,111

[22] Filed: Feb. 20, 1990

[51] Int. Cl.[5] ..... H01R 33/02

[52] U.S. Cl. ..... 439/235

[58] Field of Search ..... 439/226, 228, 235, 236, 439/237, 238, 239, 240, 241, 242, 243, 244

[56] References Cited

U.S. PATENT DOCUMENTS

| | | | |
|---|---|---|---|
| 2,292,190 | 8/1942 | Young | 439/239 |
| 2,487,467 | 11/1949 | Naysmith | 439/240 |
| 2,663,852 | 12/1953 | Kershaw | 439/241 |
| 3,135,822 | 6/1964 | Baran et al. | 147/59 |
| 4,387,509 | 6/1983 | Dechelette | 83/620 |
| 4,475,064 | 10/1984 | Burgess | 439/226 |
| 4,729,740 | 3/1988 | Crowe et al. | 439/76 |
| 4,799,134 | 1/1989 | Pinch et al. | 439/226 |
| 4,820,189 | 4/1989 | Sergeant et al. | 439/395 |

*Primary Examiner*—Joseph H. McGlynn
*Assistant Examiner*—Hien D. Vu
*Attorney, Agent, or Firm*—Robert W. Pitts; Allan B. Osborne

[57] ABSTRACT

A fluorescent light fixture employing modular prewired endcaps as depicted herein. A one piece insulative body includes both fluorescent lamp supports and a junction block. Jumper assemblies comprising wires having socket terminals and junction interconnect terminals on opposite ends are assembled in cavities in the insulative body on the inner face of the insulative body. The insulative body can then be attached to the hood of the fluorescent lamp assembly and lead wires can be attached between the endcap assembly and other components such as ballasts on the fluorescent lighting fixture.

21 Claims, 10 Drawing Sheets

FLUORESCENT LIGHT CONNECTOR ASSEMBLY

BACKGROUND OF THE INVENTION

1. Field of the Invention

This invention relates to a fluorescent light assembly and more particularly to a connector assembly for use in a fluorescent light assembly in which the connector subassembly can be mounted as part of the fixture before wires are interconnected between the connector subassembly and other subassemblies in the light fixture.

2. Description of the Prior Art

Fluorescent lamp fixtures having a plurality of fluorescent tubes mounted in the same assembly are now fabricated by the assembly of a number of discrete components. One analysis of the manufacturing process currently employed in the construction of a four bulb fluorescent light fixture has established that assembly of one fixture requires forty-seven different operations. Among the individual components which must be assembled in a conventional fluorescent light assembly are individual fluorescent socket members, each of which have five parts; metal end caps to which the socket members must be attached; socket lead wires which must be attached to individual terminals in the socket; fluorescent ballasts which include a plurality of components mounted on a printed wiring board and have discrete wires extending from the encapsulated ballast. In a conventional assembly operation, lead wires are inserted into poke in terminals in the socket members.

For conventional fluorescent socket members, the poke in terminals are inserted into the rear of an insulative housing with spring members protruding into the socket interface section. The poke in terminals, have spring fingers located at the opposite end. Two terminals are loaded in each housing from the rear and a cardboard cover plate is then secured to the rear. Wires are inserted into engagement with the poke in terminals through openings in the insulative housing of the socket member below the socket interface. These wires are perpendicular to the face containing the socket interface to which the fluorescent tube is inserted.

Individual socket members can then be attached to the metal end frame with the wires leading to the individual socket members laced along the rear face of the metal plate. As shown in FIG. 20 which depicts the prior art configuration, these individual wires attached to the socket members can be laced through an opening in the middle of the metal cap. Alternatively, wires can be attached to separate pin and socket electrical connectors which are secured within openings on the metal end frame.

The metal end frame containing a plurality of sockets is then mounted to the fluorescent light fixture housing. Fluorescent ballasts, each comprising a plurality of components mounted on a printed circuit wire board encapsulated within a metal can, are separately mounted on the lighting fixture frame. In one prior art configuration the plurality of fluorescent ballasts are attached to a metal hood between end cap subassemblies which are attached adjacent the ends of the fluorescent lamp hood. At this point discrete wires attached to the ballast must then be attached to wires leading from the socket member located on the end of the fluorescent light assembly. A conventional means of forming this attachment is the use of standard wire nuts to interconnect the two sets of wires. Connectors can also be secured to the ends of the wires leading from the ballast so that the ballast connector can be attached to the mating connector mounted on the end cap frame. In any event, these assembly methods require a number of steps in which loose wires extending from the components, such as the ballast or the end cap frames, must be handled. Damage to the components, wiring errors and other assembly problems can have a serious effect on the quality and efficiency of the assembly operation.

One technique for simplifying the assembly of a fluorescent light fixtures is shown in U.S. Pat. No. 4,729,740. This patent shows a fluorescent ballast which is assembled with ballast end caps which include a connector having poke in terminals. This permits the ballast to be handled and installed prior to the attachment of discrete wires to the ballast. Poke in terminals are provided which allow stripped ends of discrete wires to be inserted into the ballast after it is attached to the fluorescent light fixture U.S. Pat. No. 3,135,822 discloses another such component. These interconnectable ballasts, however, solve only a part of the problems inherent in the assembly of a fluorescent light fixture. The instant invention, however, employs a modular end cap subassembly in conjunction with a ballast having poke in terminals, or alternatively insulation displacement terminals, to permit the assembly of the various subcomponents of a fluorescent light fixture prior to their interconnection by discrete wires. One advantage of this approach is that the discrete wires, used to connect individual subcomponents, do not need to employ electrical terminals. These wires can either be stripped adjacent there ends for poke in insertion into connectors located on the various subcomponents, or they can remain fully insulated and be attached to insulation displacement contacts contained within the subcomponent. Combinations of insulation displacement interconnections and poke in interconnections can also be employed. By making all wire interconnections after the mounting of components, wiring errors can be reduced, and damage to the components resulting from the presence of dangling lead wires can be avoided. Elimination of these dangling lead wires also results in simpler component handling and simpler assembly steps.

This invention also employs a simplified modular endcap assembly which eliminates the assembly of individual subcomponents to the endcap assembly with the exception of the insertion of preterminated jumper assemblies comprising discrete wires extending between fluorescent lamp sockets and a central junction block formed as part of the endcap subassembly. This invention also allows the endcap to be molded as a single insulative body containing both fluorescent lamp socket supports and a junction block. Assembly of all components to this one piece insulative body can be made from one side of the insulative body.

SUMMARY OF THE INVENTION

A subassembly suitable for use in a lighting fixture assembly includes an insulative body with socket terminals and junction interconnect terminals mounted in the insulative body and connected by interconnect wires. Interconnection of the subassembly to other components and subassemblies in a lighting fixture assembly is simplified. In the preferred embodiment of this invention the subassembly comprises an endcap subassembly suitable for use in a fluorescent lighting fixture assembly. Junction interconnect terminals and socket terminals are mounted in cavities in a one piece insulative body which includes fluorescent lamp support members and a junction block. Harnesses comprising interconnect wires extending between socket terminals and junction interconnect terminals can be loaded in the endcap subassembly by inserting the terminals into cavities which extend through the flat base of an insulative body. All of the assembly of jumper harnesses to the insulative housing occurs on the inner face of the insulative body. The prewired modular endcap subassembly would then be mounted on the fluorescent lamp lighting fixture assembly. Other components can also be mounted on the lighting fixture assembly prior to the interconnection of various subcomponents. These subcomponents, such as the endcap subassembly and a premounted ballast, can be interconnected simply by attaching wires to insulation displacement or poke in terminals located in the various components.

BRIEF DESCRIPTION OF THE DRAWINGS

FIG. 3 is a front view, partially in section, of the endcap subassembly.

FIG. 9 is a view of a jumper harness in which two socket terminals are attached to a single junction interconnect terminal.

DETAILED DESCRIPTION OF THE PREFERRED EMBODIMENT

Figure 1:
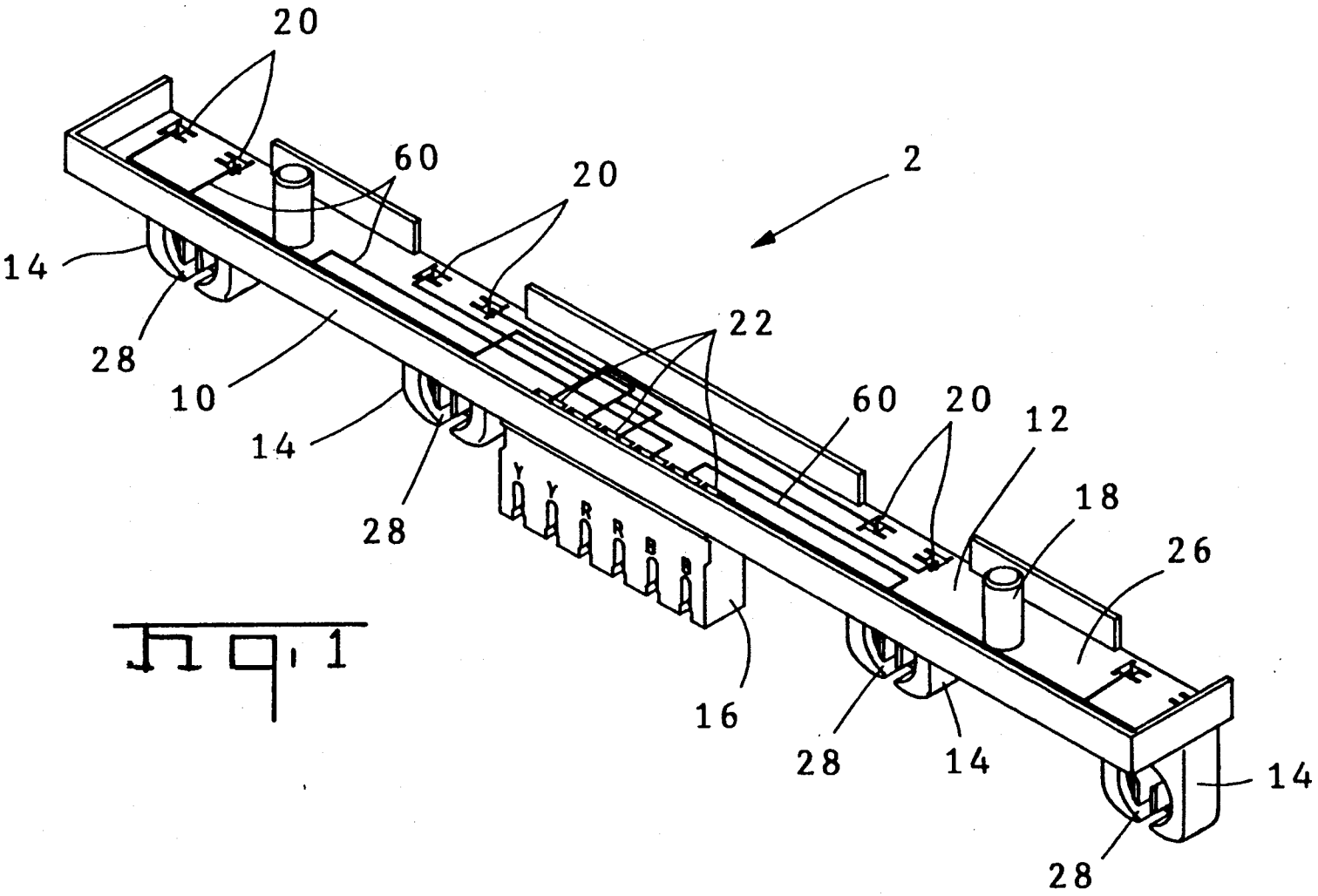
FIG. 1 is a perspective view of the endcap subassembly.
Figure 2:
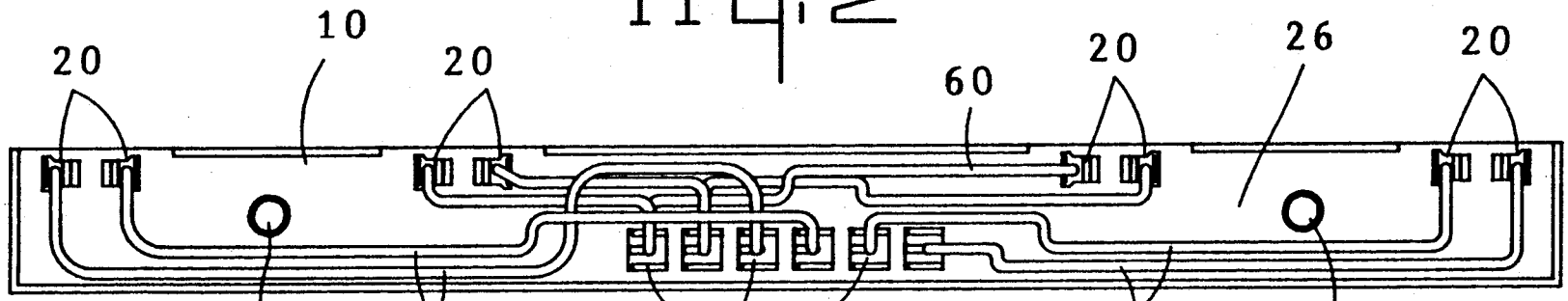
FIG. 2 is a view of the inner face of the end cab subassembly.
Figure 1:
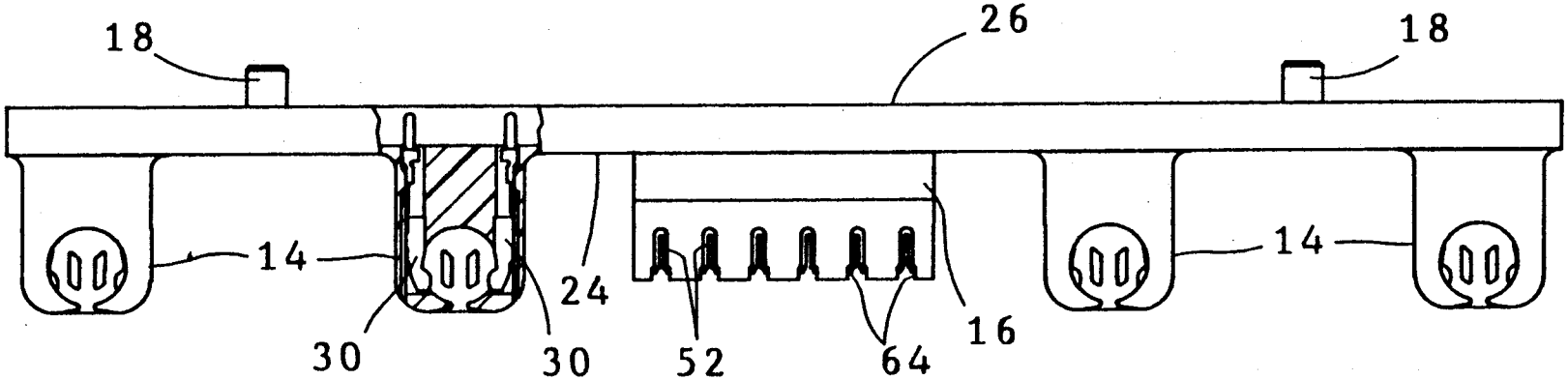
Figures 18, 19:
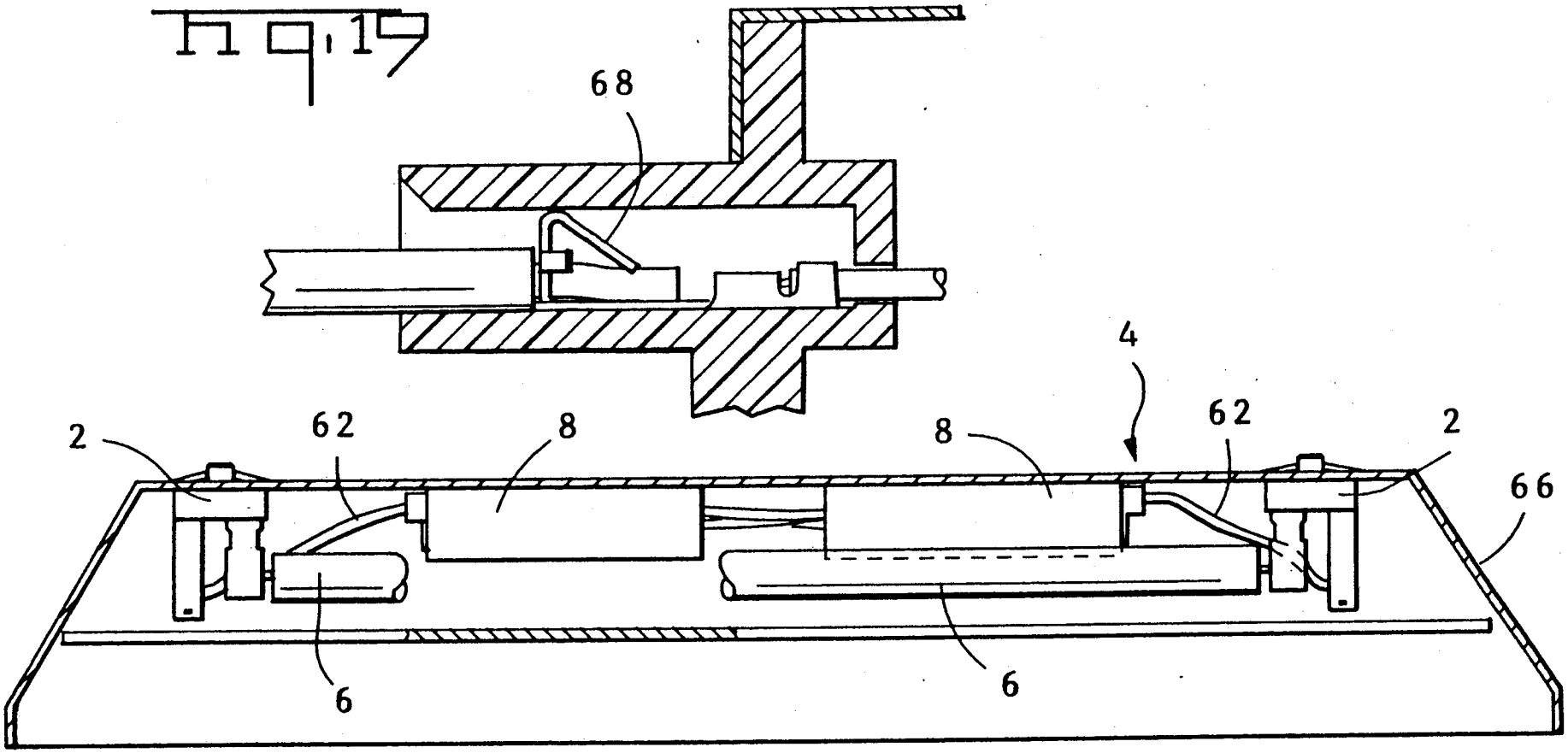
FIG. 18 is a view showing the manner in which subassembly and components of a fluorescent lighting fixture are mounted to the hood of the lighting fixture.
FIG. 19 is a view of a poke in ballast terminal.
Figure 20:
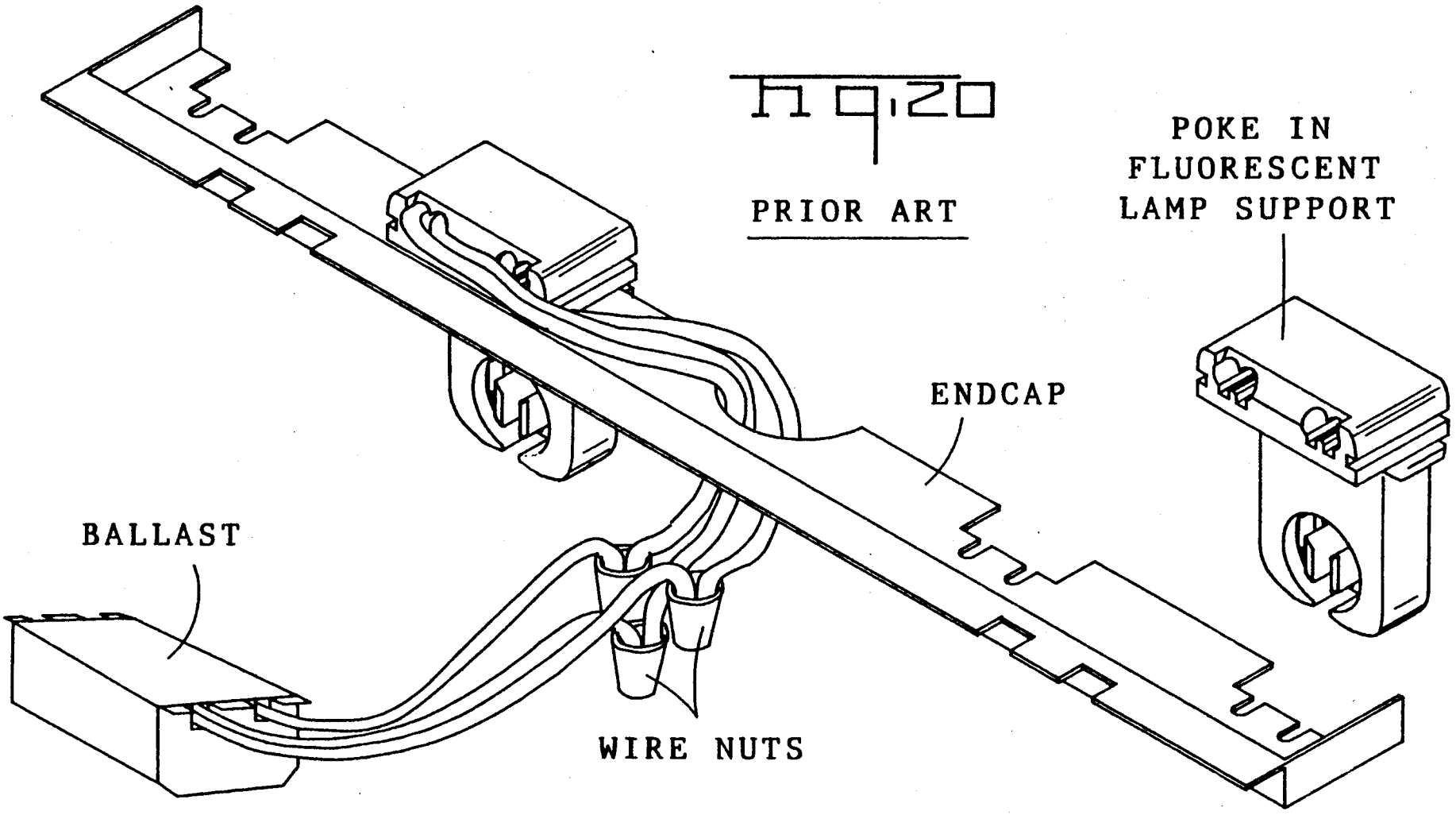
FIG. 20 PRIOR ART
FIG. 20 is a prior art view showing the manner in which individual components are currently assembled in a fluorescent lighting fixture.

The modular endcap subassembly 2 depicted in FIG. 1 is intended for use in a fluorescent light fixture assembly 4 as depicted in FIG. 18. Modular endcap subassemblies 2 are located so that fluorescent light 6 can be mounted in the fluorescent light fixture assembly by the modular endcap subassemblies 2 at each end thereof. The fluorescent light fixture assembly 4 also includes fluorescent ballast 8. Each of these components is mounted within a fluorescent lamp hood 66 of generally conventional construction.

The modular endcap subassemblies can be completely wired as a modular subassembly before incorporation into the complete lighting fixture assembly and prior to interconnection of the endcap subassembly to the other components within the lighting fixture assembly 4. Each modular end cab subassembly 2 comprises an insulative body 10 formed as a one piece molded structure in which a plurality of first fluorescent socket terminals 30 and second junction interconnect terminals 50 can be mounted to form the modular subassembly 2. In the preferred embodiment of this invention the insulative body 10 is molded from a thermoplastic material such as polyester. It should be understood that other materials can be employed in the fabrication of the insulative body 10. Insulative body 10 comprises an elongate base 12 which is generally flat and has an outwardly facing first face 24 and an inwardly facing second face 26. A plurality of first socket cavities extend from the first face 24 to the second face 26 of the flat base 12. A plurality of second junction interconnect cavities 22, all located side by side in a group, extend through a second face 26 and open onto the first face 24 of the insulative body 12. Second interconnect cavities 22 are spaced from the socket cavities 20. Each of the interconnect cavities 22 extends through a junction block 16 which comprises all of the one piece insulative body 10. Junction block 16 protrudes from the first face 24 of the insulative body 10.

The first socket cavities 20 extend through the insulative body 10 into lamp support members 14. These lamp support members 14 are insulative in construction and protrude from the first face 24 of the insulative body. These lamp support members 14 are part of the one piece molded insulative body. Two opposed first socket cavities 20 extend to each lamp support member 14. The lamp support members 14 are spaced apart at locations on each side of the group of second cavities 22 in the junction block 16, and the lamp support members 14 are located at appropriate positions for mounting the fluorescent lamps 6. The lamp support members 14 extend perpendicular to the flat base 12 on the first face 24 and comprise an insulative support body having two parallel socket cavities extending from fluorescent lamp sockets 28 to the inwardly facing second face 26 of the insulative body 10. Fluorescent lamp sockets 28 form an interface with a conventional fluorescent tube. A plurality of socket cavities 20, are spaced apart along the length of the insulative body 10 at the positions of the lamp support members 14, which extend parallel to the junction interconnect cavities 22. Two opposed socket cavities extend into each lamp support member 14.

Figure 4:
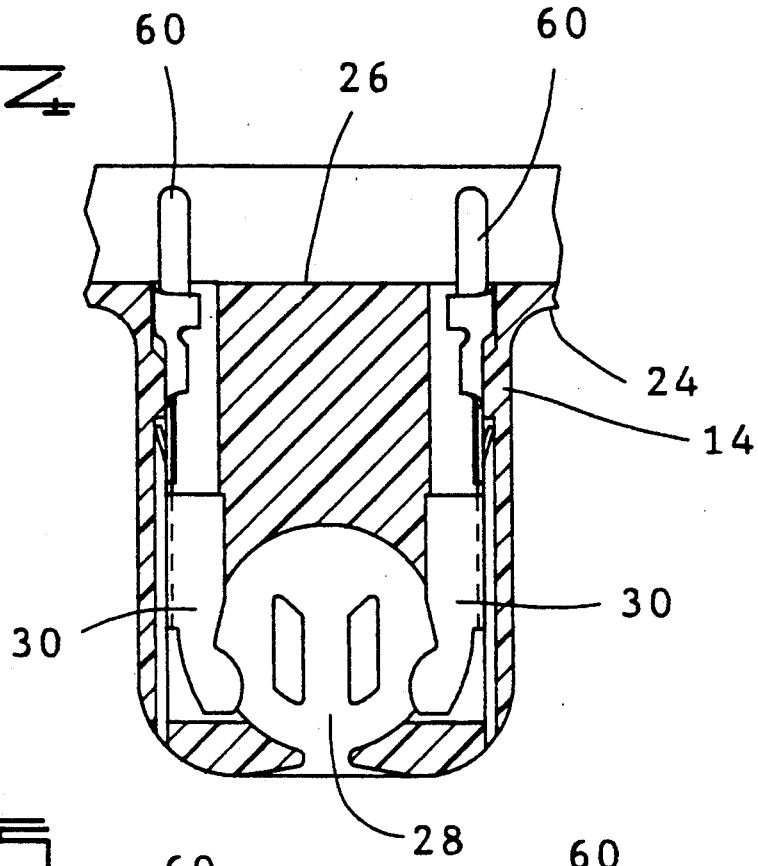
FIG. 4 is a sectional view showing the fluorescent lamp socket members with the fluorescent lamp terminals inserted therein.
Figure 5:
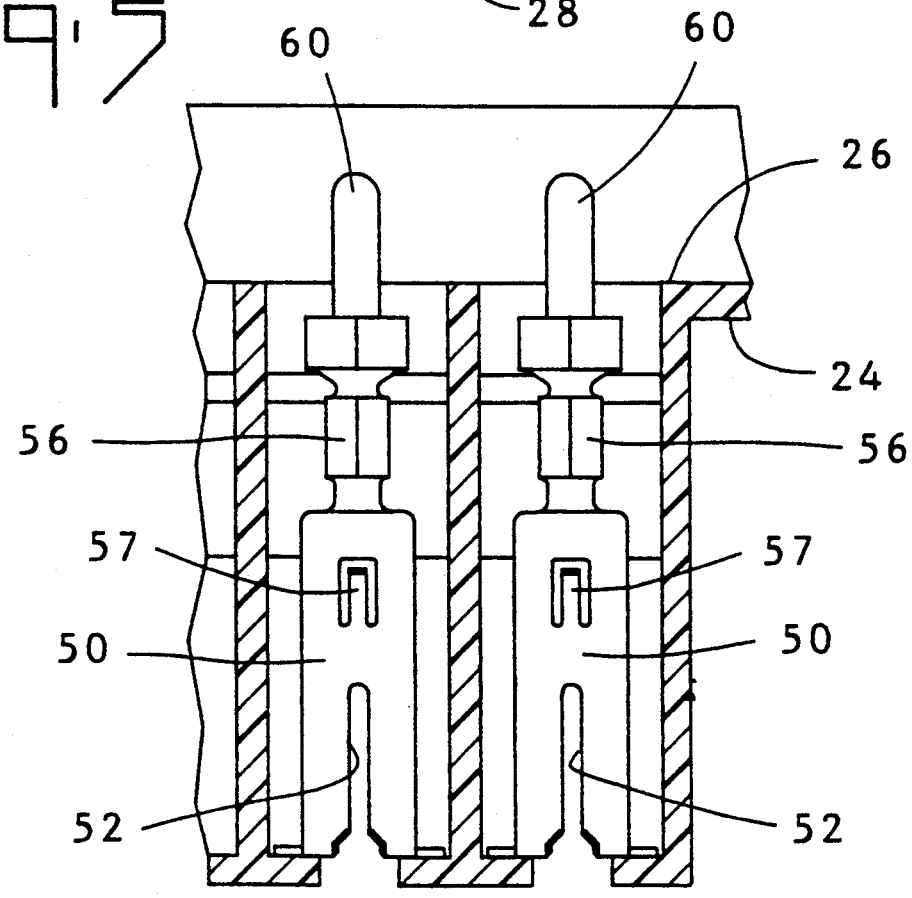
FIG. 5 is a sectional view showing the interconnect terminals positioned within cavities in the junction box.
Figure 11:
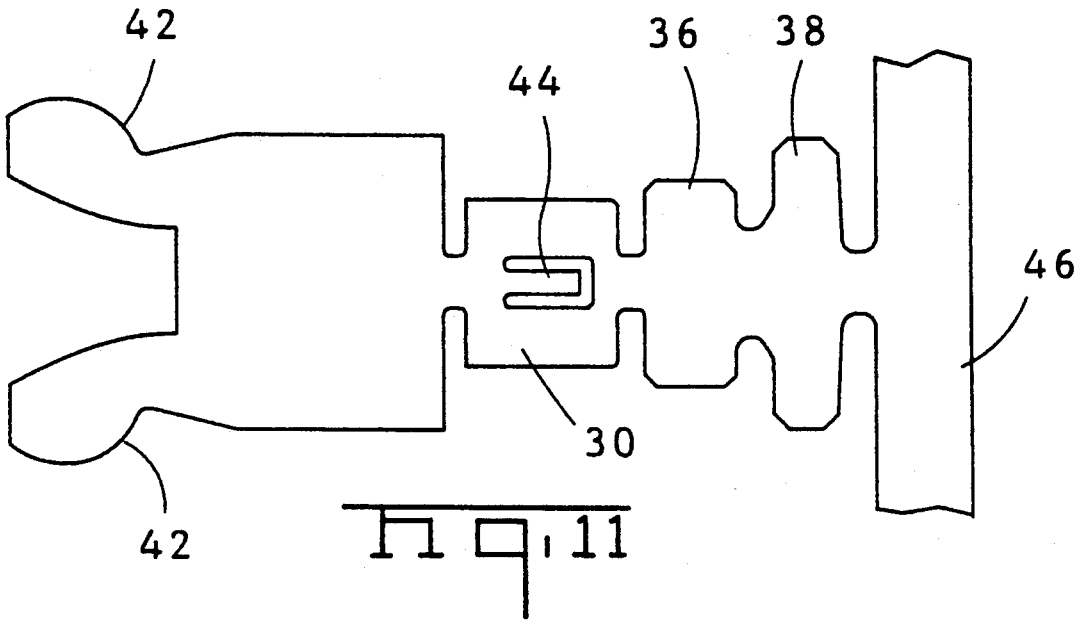
FIG. 11 is a view of the stamped metal blank from which the socket terminals are formed.
Figure 12:
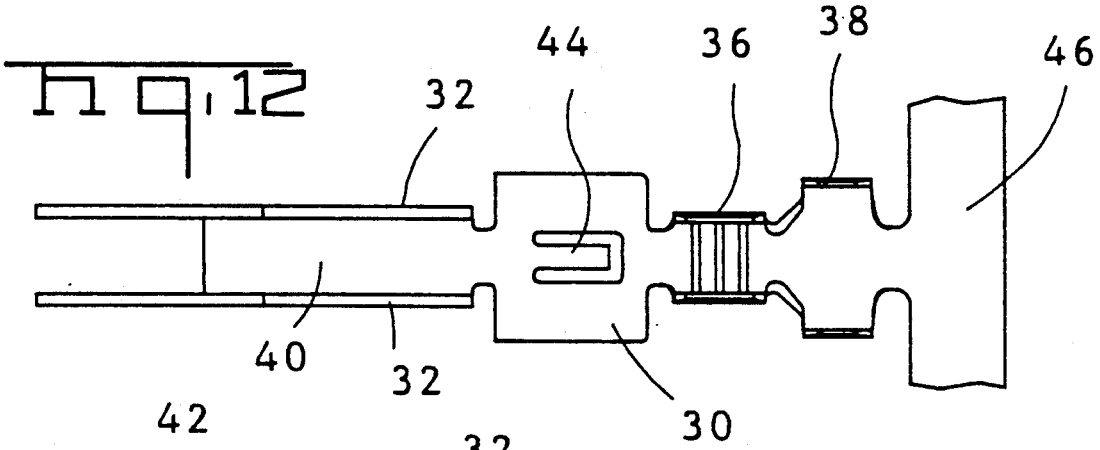
FIG. 12 is a top view of a socket terminal.
Figure 13:
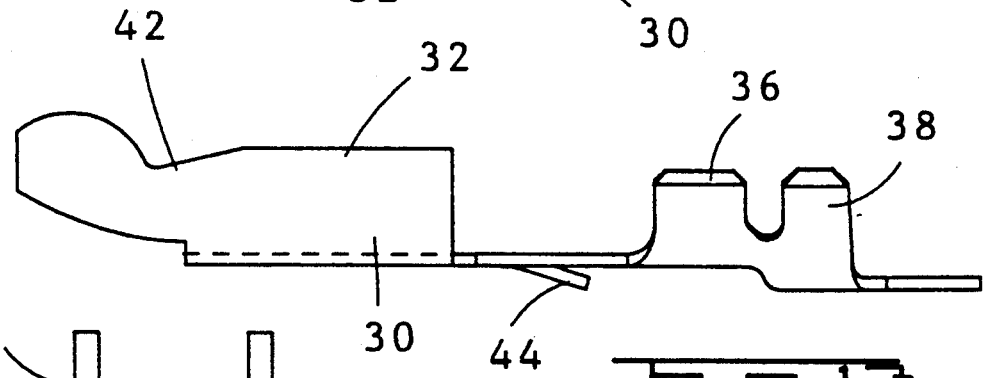
FIG. 13 is a side view of a socket terminal.
Figure 14:
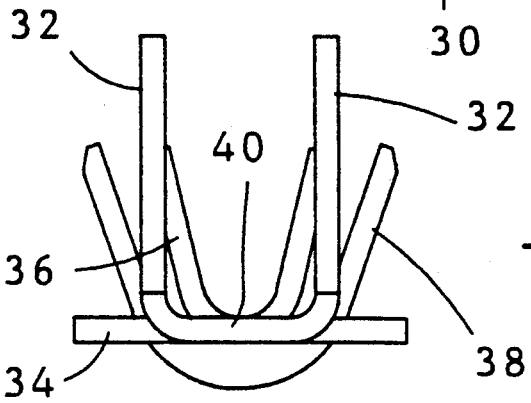
FIG. 14 is a end view of a socket terminal.

A plurality of first fluorescent socket terminals 30 are employed in each modular endcap subassembly 2. FIGS. 11 through 14 depict the construction of a single fluorescent socket terminal 30. Each fluorescent socket terminal 30 has a socket contact portion which comprises a pair of opposed sidewalls 32 which extend upwardly from a base 40. Each socket terminal 30 also includes a central section 34 between the socket contact portion and a wire terminating crimp section for securing the terminal 30 to a discrete conductor, such as a insulated wire having a stripped end. A insulation strain relief 38 is located adjacent to the crimping barrel 36. Each contact wall 32 has a contour 42 adjacent the free end which forms an edge surface suitable for establishing intimate contact with pins extending outwardly from the ends of a fluorescent lamp member 6. These two contact edges 42 on the two sidewalls 32 provide redundant interconnection for each end on the fluorescent light. An outwardly deflected lance 44 is located within the central section 34 and serves to contain the individual socket terminals within cavities 20 in the manner shown in FIG. 4. Note that the socket contact portion of the individual socket terminals extend inwardly at the socket interface 28 adjacent the lower end of the fluorescent lamp support member 14. Socket terminal 30 is insertable into the corresponding cavity 20 through the second or inner face 26 of the insulative body 10. As shown in FIG. 11, each of the socket terminals 30 is fabricated in such a manner that it may be stamped from a continuous sheet of electrically conductive metal and joined to a carrier strip 46 located adjacent the wire contact end of the socket terminal.

Figure 6:
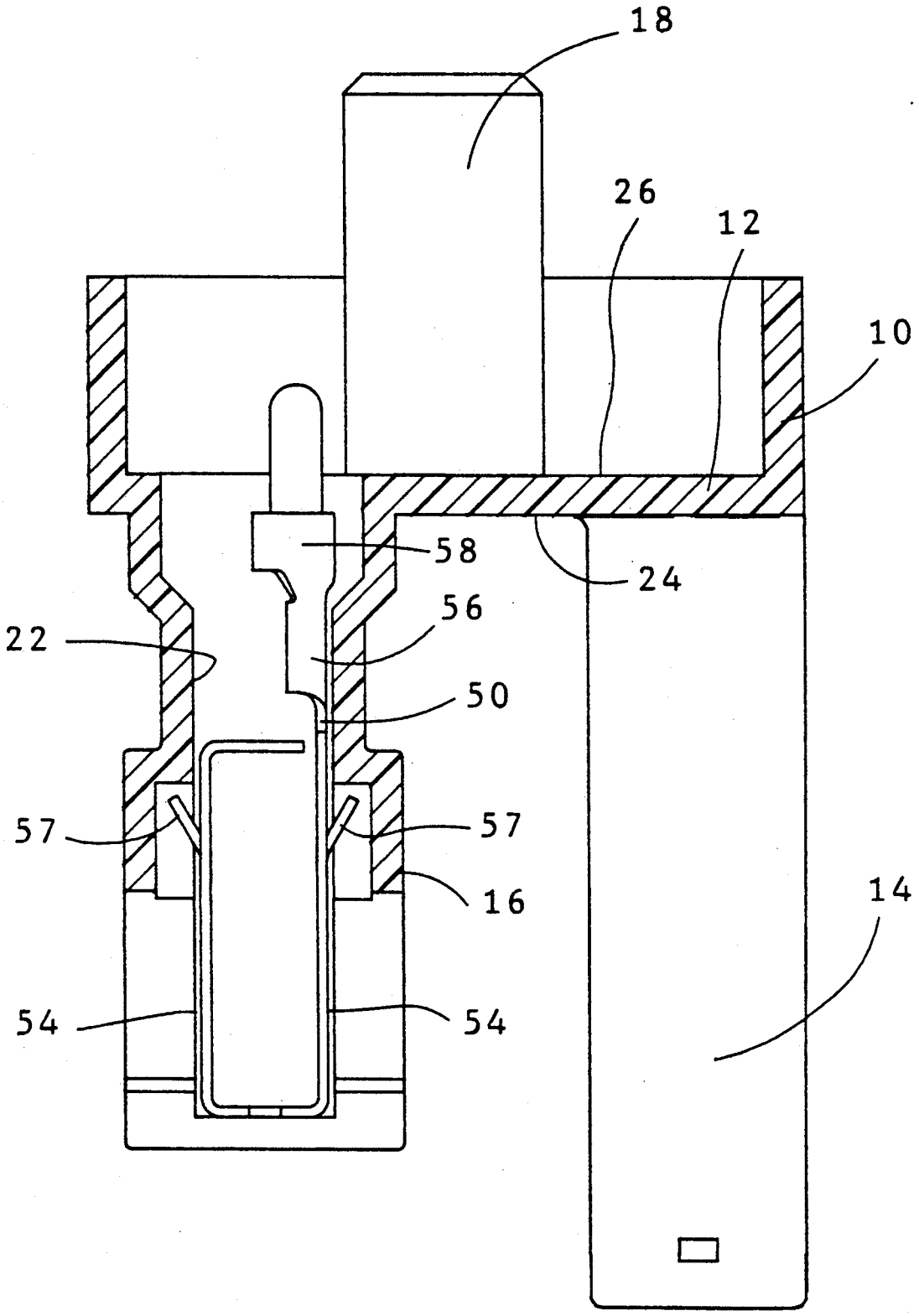
FIG. 6 is an end view, partially in section, through one cavity of a junction block, of the endcap subassembly.
Figure 7:
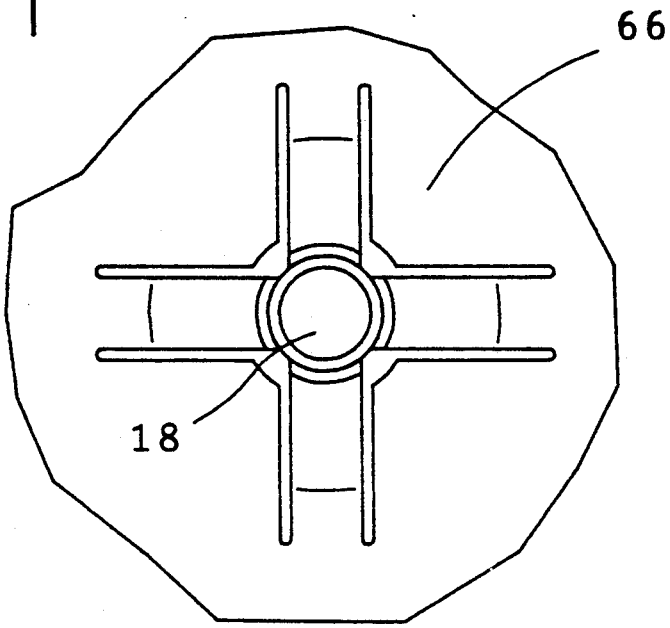
FIG. 7 is a detailed view showing the manner in which the one piece insulative body of the endcap subassembly can be mounted to a fluorescent light fixture hood.
Figure 8:
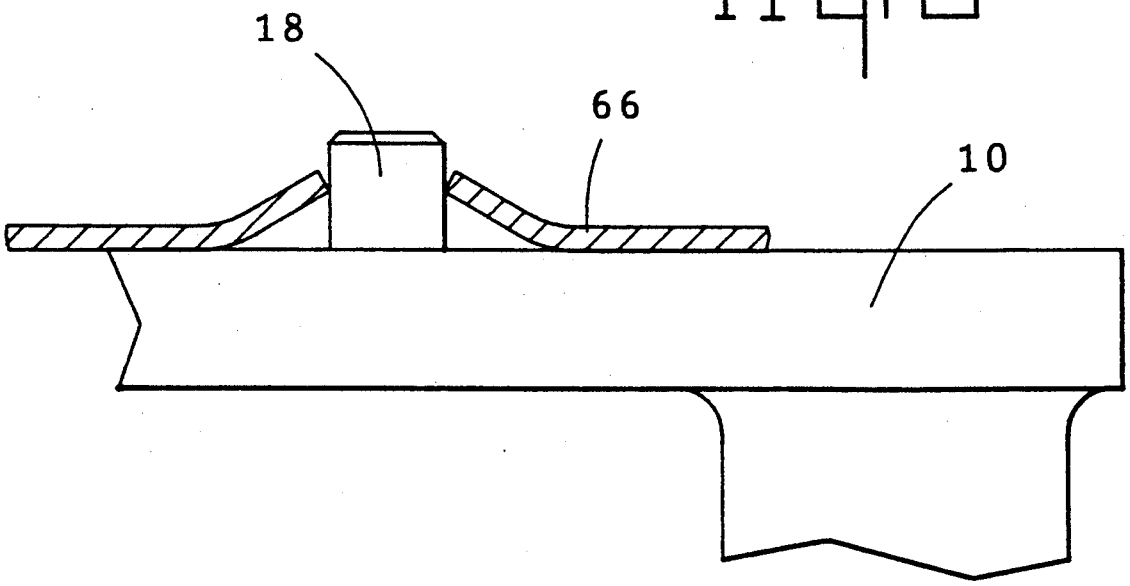
FIG. 8 is another detailed view showing the manner in which the endcap subassembly can be mounted to the fluorescent light fixture hood.
Figure 7:
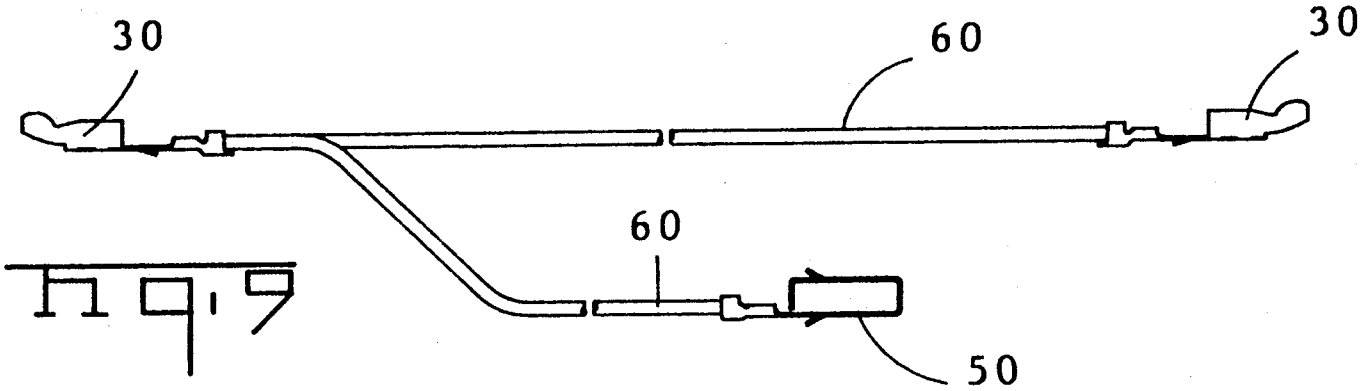
Figure 15:
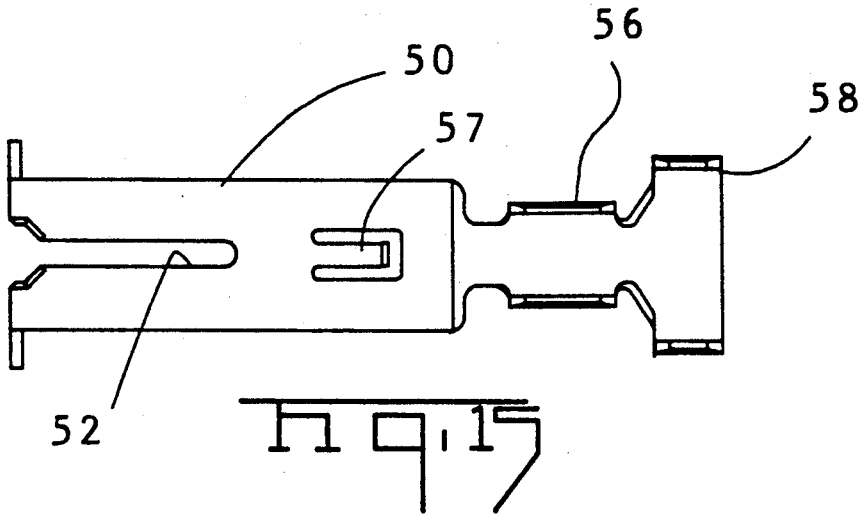
FIG. 15 is a top view of a junction block interconnect terminal.
Figure 16:
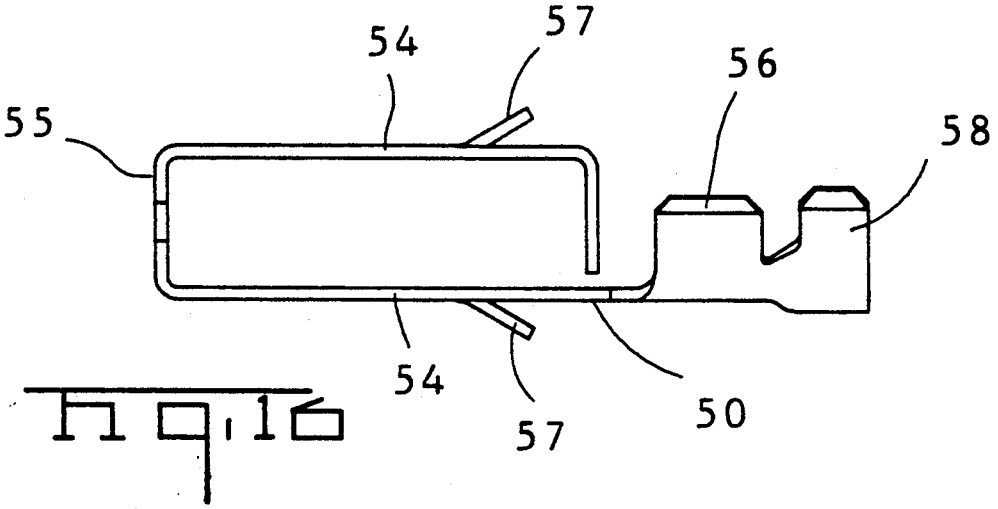
FIG. 16 is a side view of the junction block interconnect terminal.
Figure 17:
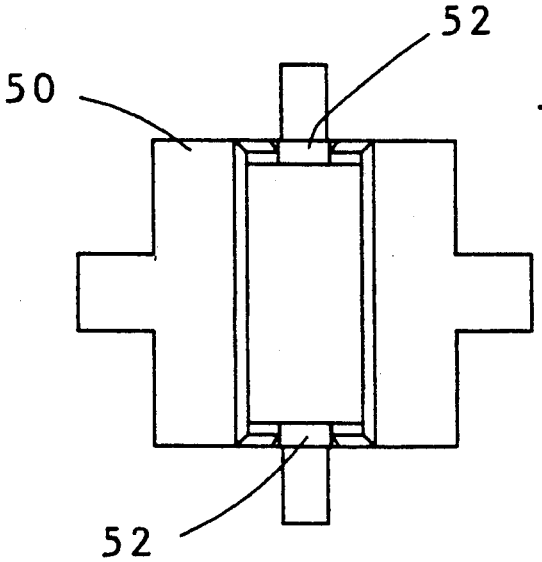
FIG. 17 is a end view of an insulation displacement junction block interconnect terminal.

The second or junction interconnect terminals 50 are shown in FIGS. 15 through 17. The socket terminals 50 have wire termination means in the form of insulation displacement wire receiving slots 52 exposed on the first face 24 of the insulative body 10. Wire crimping barrel 56 is located at the rear of each of the interconnect terminals 50, and an insulation support barrel 58 is provided in conventional manner. The interconnect terminal 50 is formed from a flat member and the insulation displacement contact section is formed of two parallel plates 54 joined by an intermediate bight member 55. The wire receiving slot 52 extends downwardly from the bight section over a portion of the length of the plate 54. Tabs 57 are struck outwardly from plates 54 for interengagement with the interconnect cavity walls in the manner show in FIG. 6. The interconnect terminals 50 are inserted into the interconnect cavities 22 in the junction block 16 so that each of the wires leading to slot 52 is aligned with wire entry slot 64 as shown in FIG. 3.

Figure 10:
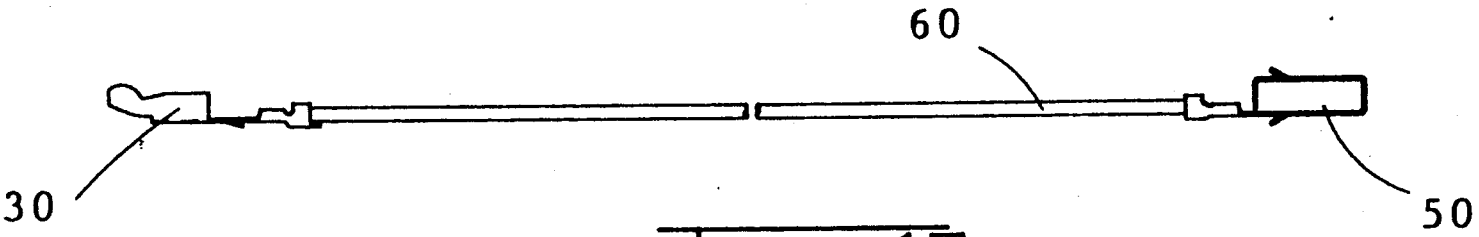
FIG. 10 is another view showing a jumper harness in which individual target terminals are interconnected to individual junction block terminals.

Point to point jumper harnesses comprising at least one fluorescent socket terminal 30 attached to at least one junction interconnect terminal 50 are used to prewire the modular endcap subassembly 2. These jumper harnesses are suitable for assembly to the insulative body 10 on the second or inner face 26. The interconnecting wires 60 are conventional insulated wires. The ends of each wire is stripped so that the ends can be attached to the respective terminal by crimping each terminal onto the stripped wire ends. The jumper harnesses are assembled to the modular endcap subassembly with both the fluorescent socket terminals 30 and the junction interconnect terminals 50 inserted into their appropriate cavities from the second face of the insulative body 10. The interconnecting wires 60 extend along the inwardly facing second face 26 of the insulative body 10. As shown in FIGS. 9 and 10, point to point jumper harnesses can be fabricated in which a single junction interconnect terminal 50 is attached first to one socket terminal 30 and then a second interconnect wire 60 is used to connect the junction interconnect terminal 50 to a second fluorescent socket terminal 30 through the first socket terminal 30. Alternatively, individual junction interconnect terminals 50 can be attached to a single fluorescent socket terminal 30 by a single interconnect wire 60. Each of these configurations is needed for prewiring a single four bulb endcap subassembly.

The individual fluorescent lamp socket members are not formed in the same manner as conventional fluorescent lamp sockets. In this configuration the individual socket terminals 30 are inserted directly into one end of the insulative fluorescent lamp support member 14. No back closure member is needed to retain the individual sockets within their appropriate cavities.

Once the endcap subassembly had been prewired in the manner just depicted, each endcap subassembly 2 can be simply mounted to an end of a fluorescent light fixture hood 66 by inserting the projections 18 extending from the inner face 26 of the insulative body 10 through holes formed by deflected tabs on the hood 66. The insulative body is wedged into engagement with the hood and is retained without the need of auxiliary fasteners.

Other components of the fluorescent light fixture assembly such as the fluorescent ballast 8 can also be assembled to the hood 66. Once the individual components and subassemblies have been attached to the hood 66, lead wires 62 can be attached to ballast contacts 68 in the ends of ballast 8 and to the corresponding interconnect terminals 50 within the junction block 16 on the insulative body 10. By attaching the lead wires 62 to the ballast 8 and the insulative body 10 after assembly of each of the subassemblies or components to the hood, all problems with loose or dangling wires are eliminated. In the instant invention an insulation displacement interconnect is used as a means for establishing contact between the lead wire 62 to the elements of the subassembly 2 and to the remainder of the lighting fixture 4. Since the insulated displacement slots 52 are exposed on the first outer face of a housing, they are easily accessible. Since each insulation displacement slot 52 is oriented in the same direction, termination of the insulated wires to the insulation displacement slot is a simple matter and can be accomplished by hand.

Although insulation displacement contacts can be employed to interconnect the lead wire 62 to the ballast, the instant invention contemplates the use of poke in ballast terminals 68 mounted in cavities in an insulative side closure member of the ballast 8. These poke in terminals 68 are crimped to wires extending into the interior of the ballast. Each ballast contact is folded upwardly from its base and is then formed at a angle to define a deflectable gripping tab suitable for engagement with a stripped end of a wire. A hole is provided in the upright portion of the poke in contact between the base and the downwardly extending inclined contact tab. A wire inserted into ballast poke in terminal 68 will be trapped between two metal surfaces and is not supported by plastic on one side of the electrical termination.

The preferred embodiment of the instant invention as depicted herein permits simple, rapid and reliable assembly of a fluorescent lamp fixture. It should be appreciated that other embodiments of this invention would be obvious to one of ordinary skill in the art in light of this disclosure. For example, the insulative body of the modular endcap could be formed by interconnection of a plurality of distinct subcomponents. Alternatively, means could be provided for employing flat conductors to interconnect the terminals in the insulative body. Other types of individual terminals could also be employed. For example, a poke in terminal could be employed in a junction block, if desired. It would therefore be appreciated by one of ordinary skill in the art that the subject matter of the claimed invention herein is not limited to the specific embodiment depicted herein.

We claim:

1. A subassembly for use in a lighting fixture assembly, comprising:

an insulative body having a plurality of first and second cavities extending from a first face to a second face;

a plurality of insulative lamp support members protruding from the first face of the insulative body, first cavities extending through the insulative body and into the lamp support members, said insulative body and insulative lamp support members being part of a one-piece molded structure;

a plurality of first terminals in the first cavities and second terminals in the second cavities, corresponding pairs of first and second terminals being joined by interconnecting wires extending therebetween along the second face, the first terminal including means for establishing contact with a lamp inserted into a support member, the second terminal including means, exposed on the first face, for establishing contact with lead wires interconnecting the subassembly to the remainder of the lighting fixture, whereby the subassembly can be completely wired as a modular subassembly before incorporation into a complete lighting fixture assembly.

2. The subassembly of claim 1 wherein the first and second terminals are insertable into corresponding first and second cavities from the second face of the insulative body.

3. The subassembly of claim 1 wherein two opposed first cavities extend into each lamp support member.

4. The subassembly of claim 3 wherein the second cavities are positioned within a common block on the first face of the insulative body.

5. The subassembly of claim 3 wherein the second cavities are all located side by side in a group, and lamp support members are disposed at spaced apart locations on each side of the group of second cavities, interconnecting wires extending from the second cavities outward to the first terminals in the lamp support members.

6. The subassembly of claim 5 wherein the means for establishing contact with lead wires on each second terminal comprises an insulation displacement slot, each insulation displacement contact being oriented in the same direction.

7. The subassembly of claim 1 wherein each of the first and second terminals include crimping means for securing the corresponding terminal to the interconnecting wire, first and second terminals and interconnecting wires comprising preassembled jumper harnesses suitable for assembly to the insulative body on the second face to form the modular subassembly.

8. The subassembly of claim 7 wherein at least one second terminal is interconnected to two first terminals by two interconnecting wires.

9. An endcap subassembly for use in a fluorescent light fixture assembly, comprising:

an insulative body securable at an end of the fluorescent light fixture and including a flat base having an outwardly facing first face and an inwardly facing second face;

a plurality of fluorescent lamp supports, extending perpendicular to the flat base on the first face, each lamp support comprising an insulative support body having two parallel socket cavities extending from fluorescent lamp sockets to the inwardly facing second face of the insulative body;

a fluorescent socket terminal in each socket cavity, each socket terminal having wire termination means positioned adjacent the inwardly facing second face, each socket terminal being insertable into the corresponding socket cavity through the second face;

a plurality of interconnect cavities extending through the second face and opening onto the first face of the insulative body, the interconnect cavities being spaced from the socket cavities;

a plurality of interconnect terminals each positioned within a corresponding interconnect cavity, each interconnect terminal having wire termination means exposed on the first face of the insulative body; and wires attached to corresponding fluorescent socket terminals and interconnect terminals, the wires extending along the inwardly facing second face of the insulative body, whereby fluorescent lamp sockets can be prewired in a modular subassembly for inclusion into a fluorescent lamp fixture assembly.

10. The endcap subassembly of claim 9 wherein the interconnect terminals each comprise terminals having wire receiving slots, each interconnect terminal being located in interconnect cavities extending through a block protruding from the first face of the insulative body, the block having a plurality of wire entry slots aligned with the wire receiving slots.

11. The endcap subassembly of claim 9 wherein each fluorescent socket terminal is crimped to a wire extending to a corresponding interconnect terminal which is also crimped to the wire.

12. The endcap subassembly of claim 9 wherein means are provided on the inner face of the insulative body for attaching the insulative body to a fluorescent lamp hood.

13. The endcap subassembly of claim 9 wherein the lead wires terminated to the interconnect terminals extend to a fluorescent ballast.

14. The endcap subassembly of claim 9 wherein the socket cavities and the interconnect cavities are parallel.

15. The endcap subassembly of claim 9 wherein the lamp supports are molded as part of a one-piece insulative body.

16. The endcap subassembly of claim 15 wherein a plurality of lamp supports are spaced apart along the length of the insulative body and all of the interconnect cavities are closely adjacent.

17. The endcap subassembly of claim 16 wherein each of the interconnect cavities extend through a block protruding from the first face of the insulative body.

18. The endcap subassembly of claim 17 wherein the block is molded as part of a one-piece insulative body.

19. A method of assembling a fluorescent light fixture, comprising the steps of:

locating individual point to point harnesses, each having at least one fluorescent socket terminal and a corresponding interconnect terminal to an intervening conductor, along an inter face of an insulative body by inserting the fluorescent socket terminals into socket cavities and interconnect terminals into interconnect cavities, each cavity extending from the inner face to an outer face of the insulative body so that a each terminal is exposed on the outer face of the insulative body.

attaching the insulative body to a fluorescent light fixture hood with the inner face being positioned adjacent the hood and the outer face facing away from the hood;

attaching a fluorescent ballast to the hood, the fluorescent ballast having ballast contacts having an exposed wire contact section; and interconnecting appropriate ballast contacts to corresponding interconnect terminals by attaching lead wires to the ballast contacts and the interconnect terminals after the ballast and the insulative body has been attached to the hood.

20. The method of claim 19 wherein the lead wires are attached to insulation displacement slotted plate contacts on the interconnect terminals.

21. The method of claim 20 wherein the lead wires are attached to poke in contacts which comprise the ballast contacts on the ballast.

* * * * *